US005815974A

United States Patent [19]

Keng

[11] Patent Number: 5,815,974

[45] Date of Patent: Oct. 6, 1998

[54] BIPOD MOUNTING DEVICE

[76] Inventor: Da Keng, 875 Wharton Dr., SW., Atlanta, Ga. 30336

[21] Appl. No.: 891,627

[22] Filed: Jul. 9, 1997

Related U.S. Application Data

[63] Continuation-in-part of Ser. No. 542,822, Oct. 13, 1995, Pat. No. 5,711,103.

[51] Int. Cl.[6] ..... F41A 23/10

[52] U.S. Cl. ..... 42/94

[58] Field of Search ..... 42/94; 89/37.04, 89/40.06; 248/187.1, 177.1

[56] References Cited

U.S. PATENT DOCUMENTS

| | | | |
|---|---|---|---|
| 1,594,365 | 8/1926 | Haubroe | 89/37.04 |
| 1,919,554 | 7/1933 | Howell | 248/187.1 |
| 1,977,629 | 10/1934 | Heavey | 89/40.06 |
| 2,081,929 | 6/1937 | Heavey | 89/40.06 |
| 2,991,579 | 7/1961 | Lies | 42/94 |
| 3,006,052 | 10/1961 | Stickney et al. | 248/187.1 |
| 3,029,053 | 4/1962 | Loehnis | 248/187.1 |
| 3,802,138 | 4/1974 | McCarter | 52/148 |
| 4,085,915 | 4/1978 | Song et al. | 248/187 |
| 4,570,887 | 2/1986 | Banister | 248/187 |
| 4,903,425 | 2/1990 | Harris | 42/94 |
| 5,194,678 | 3/1993 | Kramer | 42/94 |
| 5,345,706 | 9/1994 | Brown | 42/94 |

*Primary Examiner*—Charles T. Jordan
*Assistant Examiner*—Christopher K. Montgomery
*Attorney, Agent, or Firm*—Isaf, Vaughan & Kerr

[57] ABSTRACT

A bipod mounting assembly for attaching a bipod to the forearm stock portion of a firearm, which includes a mounting yoke adapted to quickly and easily attach to the swivel stud connector mounted to the forearm stock portion of the firearm. The mounting yoke is adapted to receive a mounting block thereover, with the mounting block being attached to the mounting yoke to thus attach the mounting block to the forearm stock portion of the fire arm. A bipod mounting frame that includes a pair of extensible telescoping legs is releasably attachable to the mounting block by a quick-release locking catch to enable the quick attachment/detachment of the legs of the bipod from the mounting block, and thus the firearm. In one embodiment the mounting yoke has a threaded stud that extends through the mounting block and receives a securing bolt to secure the mounting block to the firearm.

12 Claims, 4 Drawing Sheets

BIPOD MOUNTING DEVICE

REFERENCE TO RELATED APPLICATION

This application is a continuation-in-part of U.S. patent application Ser. No. 08/542,822 filed on Oct. 13, 1995, now U.S. Pat. No. 5,711,103.

FIELD OF THE INVENTION

The present invention generally relates to firearm support devices. In particular, the present invention relates to a mounting device for attaching a bipod support to the forearm stock of a firearm. The mounting device attaches to the swivel stud of the firearm to enable the quick and easy attachment and detachment of the bipod to the firearm without modification of the forearm stock of the firearm.

BACKGROUND OF THE INVENTION

When shooting firearms, it is important that the firearm be maintained in a steady, stable position to insure accuracy of aim. However, most shooters are not able to hold a firearm consistently in a set position without wavering, especially after the onset of fatigue and strain being placed on the shooter due to the size and weight of the firearm. Accordingly, peripheral support devices have been used in conjunction with firearms since the early creation of firearms as a means of stabilizing a firearm to reduce vibration, wavering, etc., and to improve accuracy thereof.

In the past, shooters have used everything from large stationary objects such as rocks and tree branches to forked sticks, shooting slings, bipods and tripods. Early bipod and tripod supports typically were somewhat crude strands that generally were bulky, inconvenient and difficult to use and typically were not easily adjustable. In more recent times, bipod supports have been developed that are compact and relatively lightweight and are mountable to the forearm stock of a firearm, such as a rifle, so as to make the bipods portable with the firearm. Most conventional bipod supports include a pair of legs that can be pivoted from an up position adjacent the firearm stock, to a down position engaging a support surface, with the legs also being extensible to adjust the height of the support.

A problem with conventional bipods has been the ability of the bipod to mount to most firearms without requiring the use of special mounting tools and the machining or modification of the firearm stock to accommodate the bipod. Additionally, most bipods are not designed for quick and easy attachment and release of the bipod from the firearm stock. For example, U.S. Pat. No. 5,194,678 discloses a bipod assembly that includes legs that are pivotable independently of one another for ease of adjustment, but which is not easily attached/detached from the firearm. Other types of conventional bipods offer varying types of mountings that can be fitted to various types of rifles without requiring modification or machining of the rifle stock. For example, Harris Engineering, Inc. manufactures a series of bipod mounts for use with a variety of different firearms. However, these bipod mounts do not provide for the quick-release of the bipods from the firearm.

Further, one of the most popular bipods on the market has been the Parker-Hale bipod assembly. This bipod includes a pair of telescoping legs attached to a mounting frame, and a mounting block for mounting the bipod to the firearm. The mounting block of the Parker-Hale bipod is releasably attached to the mounting frame of the bipod to enable quick attachment/release of the legs of the bipod from the firearm.

The problem with the Parker-Hale bipod is that to mount the bipod to a firearm, the forearm stock of the firearm generally must be modified to mount a track or slide therein, along which the mounting block is received to mount the bipod to the firearm. Such modifications generally are expensive and often must be done by specialty gunsmiths and can mar the finish of the firearm.

Accordingly, it can be seen that a need exists for a bipod mounting device for attaching a bipod to a firearm without requiring extensive modification and machining of the forearm stock of the firearm and which enables the quick attaching and detaching of the bipod from the firearm.

SUMMARY OF THE INVENTION

Briefly described, the present invention comprises a bipod mounting device for mounting a bipod support to the forearm stock of a firearm such as a riffle. In particular, the present invention is directed to use for mounting a Parker-Hale type firearm bipod of the type including a contoured mounting block adapted to attach to the forearm stock of the firearm. The mounting block is releasably attachable to a bipod mounting frame by means of a quick release connector such as a bayonet lock or similar locking means. The bipod mounting frame includes a pair of extensible/ retractable legs, each having a pair of telescoping sections to enable the height of the bipod to be adjustable as desired.

The bipod mounting device of the present invention generally comprises a substantially U-shaped mounting yoke that is adapted to be received within a cubically shaped recess or aperture formed on the upper side surface of the mounting block of the bipod. The yoke includes a substantially square-shaped base plate of a size slightly less than the size of the recess formed in the mounting block, and includes a pair of parallel sidewalls extending upwardly therefrom. The base plate is a substantially flat plate having, in one embodiment, a threaded opening or bore formed approximately through the center thereof. In another embodiment, a threaded stud is attached to and projects downwardly from the base plate. The sidewalls are spaced, substantially square-shaped walls and are adapted to fit about and straddle the sides of a swivel stud mounted to the forearm stock of the firearm, with the head of the swivel stud being received between the side walls. The swivel stud is a standard element of the firearm and normally is used for attachment of one end of a shoulder sling to the forearm stock. The side walls of the yoke include aligned fastener openings through which a fastener is received and attaches to the side walls, with the shank of the fastener extending through the head of the swivel stud to attach the yoke to the swivel stud.

Once the yoke has been attached to the swivel stud of the firearm, the mounting block of the bipod is placed on the yoke, with the yoke received within the recess formed in the upper surface of the mounting block. In one embodiment, a securing bolt assembly is extended through the bottom surface of the mounting block. The securing bolt assembly engages the threaded opening in the base plate of the yoke to attach the mounting block to the yoke and thus to the forearm stock of the firearm. In another embodiment, the depending threaded stud of the yoke extends through a corresponding hole in the block and a securing bolt assembly is threaded onto its projecting end. The resulting attachment of the mounting block to the forearm stock provides a quick and easy attachment of the mounting block to the firearm and enables the mounting block to mount securely to the forearm stock of the firearm in a stable, secure position.

This prevents the mounting block, and thus the bipod, from shifting or wobbling during use. With the mounting block securely mounted to the forearm stock of the firearm, the bipod frame is placed in locking engagement with the mounting block to mount the bipod frame to the firearm. Additionally, a detachable sling loop can be provided with the securing bolt assembly for attachment of a rifle sling to the stock of the firearm.

Various objects, features and advantages of the present invention will become apparent to one skilled in the art upon a review of the following specification, when taken in conjunction with the accompanying drawings.

DETAILED DESCRIPTION OF THE PREFERRED EMBODIMENTS

Figure 1:
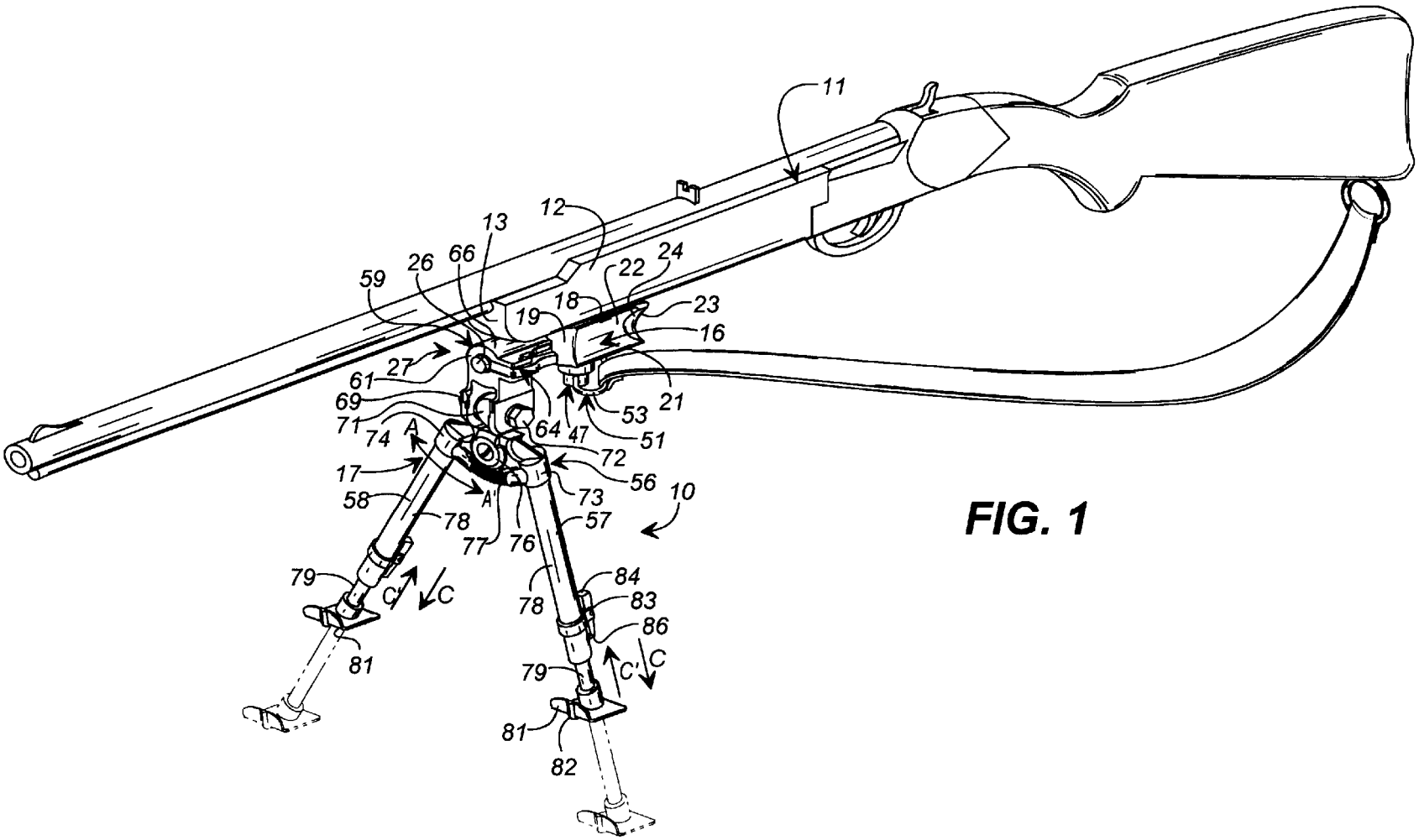
FIG. 1 is a perspective illustration of a firearm with a bipod mounted thereto.

Referring now in greater detail to the drawings in which like numerals indicate like parts throughout the several views, the present invention comprises a bipod mounting assembly for mounting a bipod 10, to a firearm 11 such as a rifle, as shown in FIG. 1. The bipod 10 generally is mounted to the forearm stock portion 12 of the firearm 11 adjacent the front end 13 of the forearm stock. By mounting the bipod to the formed stock portion of the firearm, a shooter is provided with a stable platform for use in aiming and shooting the firearm.

Figure 2:
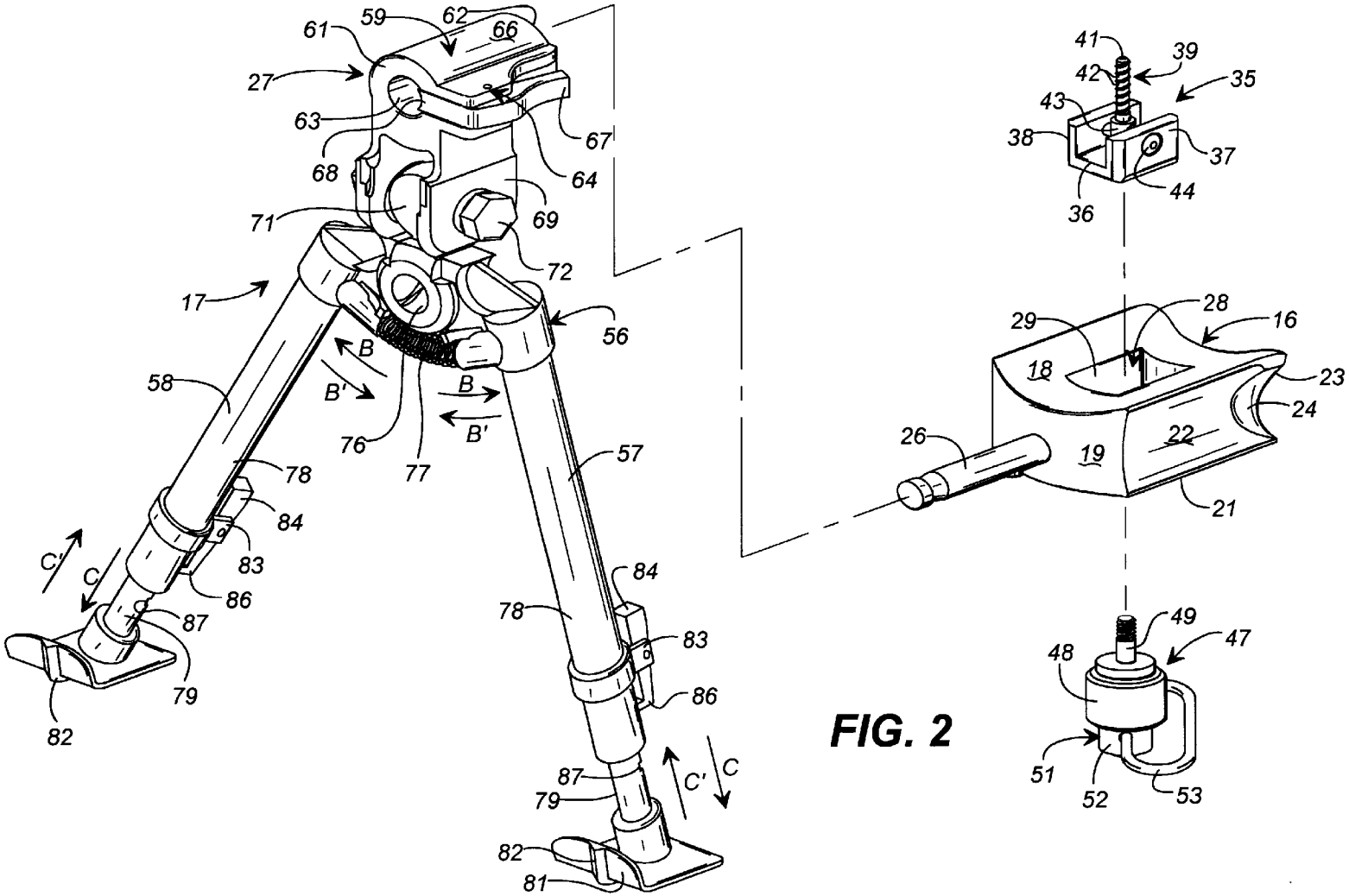
FIG. 2 is an exploded perspective view of the bipod shown in FIG. 1, and illustrating the use of the bipod mounting device of the present invention therewith.
Figure 3:
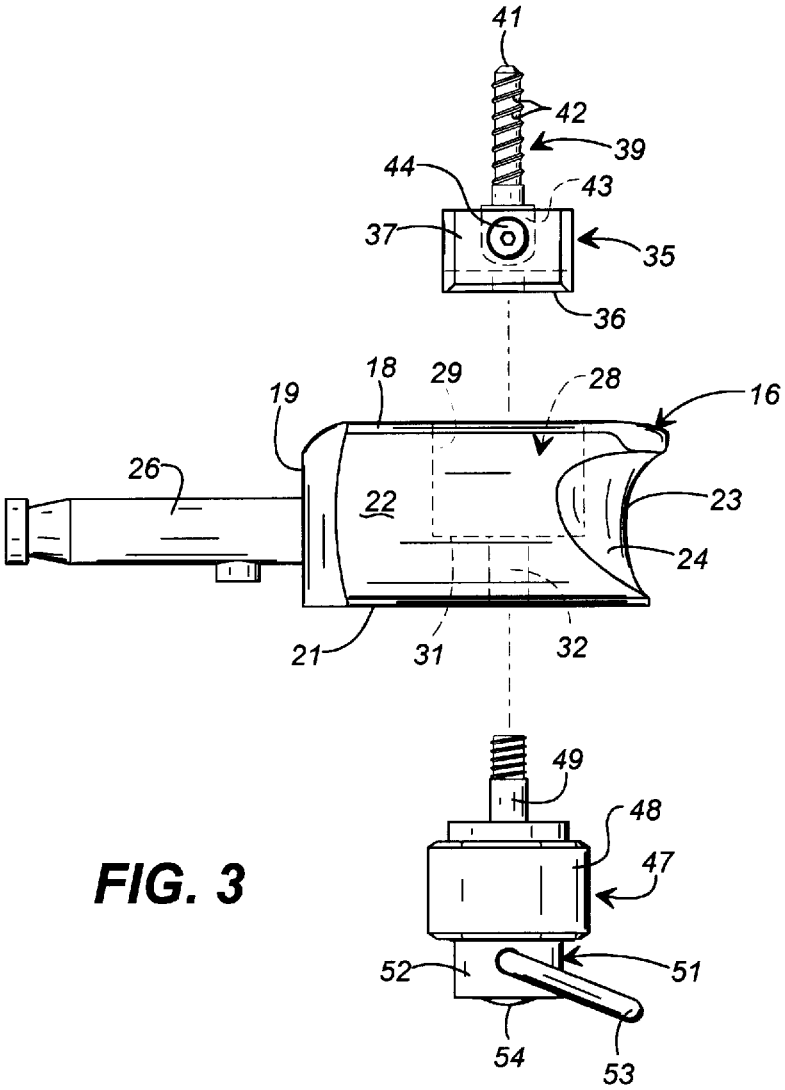
FIG. 3 is a side elevational view illustrating the attachment of the bipod mounting device of the present invention with a bipod mounting block.

As FIGS. 1 and 2 illustrate, the bipod 10 generally is a Parker-Hale type bipod that includes a contoured mounting block 16 and a bipod mounting frame 17 to which the mounting block 16 is releasably attachable. The mounting block 16 generally is a substantially rectangularly-shaped block typically formed from a plastic or similar, durable, weather resistant materials. The mounting block 16 includes a curved, concave upper surface 18, front surface 19, substantially flat bottom surface 21, concave side surfaces 22 and a curved, contoured rear surface 23. As indicated in FIGS. 2 and 3, the rear surface 23 of the mounting block 16 curves inwardly and includes shaved wing portions 24 on either side thereof, so as to give the rear surface 23 of the mounting block a contour and shape adapted to fit to the web of the hand of a shooter when a shooter holds the firearm along its forearm stock portion. The mounting block thus is configured so as to enable the shooter to easily and securely grip the forearm stock portion of the firearm when the mounting block is attached thereto, without interfering with the gripping of the firearm by the shooter. The mounting block further includes a mounting post 26 that is mounted to and extends forwardly from the front surface 19 of the mounting block. The mounting post generally is a cylindrically-shaped rod adapted to engage and lock into a locking means 27 of the bipod mounting frame 17.

As shown in FIGS. 2 and 3, an open ended recess or cavity 28 is formed in the mounting upper surface 18 of the mounting block 16. The cavity 28 generally is a substantially rectangularly or cubically shaped cavity having a series of substantially flat upstanding side walls 29 and a substantially flat bottom 31 (FIG. 3). A bore or passage 32 is formed through the body of the mounting block 16, and extends from the bottom 31 of the cavity 28 through the bottom surface 21 of the mounting block.

Figure 4:
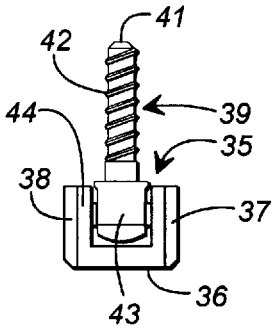
FIG. 4 is an end view illustrating the attachment of the yoke of the bipod mounting device of the present invention about the head of a swivel stud of a firearm.

A mounting yoke 35 (FIGS. 3 and 4) is adapted to be received within the side walls 29 (FIG. 3) of the cavity 28 of the mounting block 16 and functions as a means for attaching the mounting block to the forearm stock portion 12 (FIG. 1) of a firearm 11. As illustrated in FIGS. 2, 3 and 4, the mounting yoke 35 generally is a substantially U-shaped block that is formed from a metal such as steel or similar durable, high-strength material. The mounting yoke includes a substantially rectangularly shaped base 36, and a pair of spaced, parallel side walls 37 and 38 projecting upwardly from the base 36 so as to provide the mounting yoke with a substantially U-shaped cross-section. The side walls 37 and 38 are spaced apart at a distance sufficient to enable the head of a swivel mounting stud 39 for the firearm to be received and mounted therebetween. As FIG. 4 illustrates, the swivel stud comprises a threaded fastener having a shank 41 having a helical thread 42 wound thereabout and formed thereabout, and a rounded head portion 43. A fastener such as a bolt 44 is received through the side walls 37 and 38 of the mounting yoke 35 and through the head 43 of the swivel stud 39 to attach the mounting yoke to the swivel stud.

A recess 46 (FIG. 3) is formed in side wall 37 of the mounting yoke to enable the head of the fastener 44 to be countersunk into the side wall of the mounting yoke so as to lie flush with the side wall of the mounting yoke. Additionally, as shown in FIGS. 2 and 3, a detachable securing bolt assembly 47 is mounted to the mounting block 16 through the bottom surface 21 thereof. The securing bolt assembly 47 generally is substantially cylindrically shaped and is formed from a metal such as steel, and includes a body portion 48, a connecting stud 49 mounted to and extending upwardly from the upper end of the body 48 and a rifle sling connector loop 51 detachably mounted to the lower end of the body. The connector stud 49 is received throughout the bore 32 formed through the bottom surface 21 of the mounting block 16 and, as illustrated in FIGS. 2 and 3, is adapted to engage and attached to the base 36 of the mounting yoke 35. As a result, the securing bolt assembly is attached to the mounting yoke and thus to the swivel stud 39 of the firearm to secure the mounting block 16 to the forearm stock 12 (FIG. 1) of the firearm 11. The detachable connector loop 51 typically is formed as a quick release connector having a connector body 52 through which a sling loop 53 is attached and further includes a release button 54 (FIG. 3) which, when depressed, releases the connector loop 51 from the body 48 of the securing bolt assembly 47. As shown in FIG. 1, a rifle sling can be looped through the connector loop or clipped thereto to attach the rifle sling to the connector loop as desired.

As shown in FIG. 2, the mounting post 26 of the mounting block 16 is adapted to be received in locking engagement with the locking means 27 of the bipod mounting frame 17 to attach the bipod mounting frame to the mounting block and thus to the forearm stock of the firearm. As shown in FIGS. 1 and 2, the bipod mounting frame generally includes the locking means 27, pivotally mounted to leg support frame 56 from which a pair of extensible legs 57 and 58 depend. The locking means 27 includes a housing 59 having a front end 61 and a rear end 62 and a substantially cylindrically shaped bore 63 formed internally through the housing between the front and rear ends 61 and 62. The bore receives the mounting post 26 of the mounting block 16 therethrough as illustrated in FIG. 2. A locking catch or finger 64 is pivotally mounted to the side surface 66 of the housing 59, positioned adjacent the bore 63. The locking catch includes a distal or free end 67 positioned adjacent the rear end 62 of the housing, biased outwardly therefrom, and a substantially C- or hooked-shaped proximal end 68 positioned adjacent the open end of the bore 63 at the front end 61 of the housing. The engaging end 68 is biased against the front end of the mounting post 26 with the mounting post received through the bore 63 so as to lock the mounting post within the bore. The locking means further includes a pair of downwardly extending, spaced struts 69 that project downwardly from the housing and receive a ball connector 71 therebetween and are pivotally attached to the bolt connector by fastener 72 to pivotally mount the leg support frame 56 to the housing 59.

The leg support frame additionally includes a pair of pivoting connector sleeves 73 and 74 so that are pivotally connected to the bolt connector 71 by a pivot pin such as a fastener 76. The sleeves 73 and 74 further are connected to one another by a compression spring 77 that tends to bias or urge the connector sleeves apart in the direction of arrows C. The upper ends of the connector sleeves are configured so as to engage and fit between the struts 69 of the locking means when the leg support frame is folded with the legs in their retracted positioned, urged together in the direction of arrows C', and with the leg support frame pivoted to its raised, non-engaging position shown in the direction of arrow A to lock the legs in their close, together position when not in use As the legs are pivoted rearwardly in the direction of arrow A', the connector sleeves are released from engagement with the struts of the locking means and are urged outwardly to spread apart upwardly position in the direction of arrows B by the compression spring 77 to the position shown in FIGS. 1 and 2.

As illustrated in FIGS. 1 and 2, the legs 57 and 58, are substantially cylindrically shaped and generally are formed from a metal such as steel. Each of the legs includes a pair of telescoping sections 78 and 79, with section 79 being slideably received within section 78 to make the legs extensible and retractable in the direction of arrows C and C'. Feet 81 are mounted to the lower ends of sections 79 of each leg, generally formed from a metal such as steel, and also can be formed with ridges 82 or other ground engaging means to prevent slipping and provide the feet with a non-skid surface. Locking tabs 83 are attached to the telescoping sections 78 of the legs 57 and 58 adjacent the lower ends thereof. The locking tabs are pivotally mounted to the telescoping sections 78 and include an upper, free end 84 and a lower, hooked shaped engaging end 86. The hooked shaped engaging ends 86 of the locking tabs 83 are received through openings (not shown) formed in the telescoping sections 78 of the legs and engage locking recesses 87 formed in the lower telescoping sections 79 of the legs to lock the telescoping sections 79 at a set or desired height to enable adjustment of the height of the legs as desired.

In use of the bipod mounting assembly of the present invention, the mounting yoke 35 is attached to the swivel stud 39 mounted in the forearm stock portion 12 (FIG. 1) of a firearm 11 such as a rifle. The mounting yoke is attached to the swivel stud by positioning the head of the swivel stud between the side walls 37 and 38 of the yoke and inserting a fastener 44 therethrough. The size and configuration of the mounting yoke enables its attachment to the forearm stock portion of the firearm without interfering with the use and gripping of the firearm by a shooter. A mounting block 16 thereafter can be attached to the mounting yoke by simply placing the mounting block over the mounting yoke with the mounting yoke being received within the open ended cavity 28 formed through the upper surface of the mounting block. The mounting block is secured to the mounting yoke by the insertion of the connector stud 49 of a securing bolt assembly 47 through the bore 32 formed through the bottom of the mounting block and the engagement and attachment of the rifle sling connector to the base of the mounting block as indicated in FIGS. 2 and 3.

Thereafter, a bipod mounting frame 17 is received and mounted to the mounting block by the insertion of the mounting post 26 of the mounting block through the bore 63 of the housing 59 of the locking means 27 of the bipod mounting frame. The locking catch 64 enables the quick attachment/detachment of the bipod mounting frame to the mounting block as needed. Thereafter, with the bipod mounting frame connected to the forearm stock portion 12 (FIG. 1) of the firearm, the legs 57 and 58 thereof can be folded in the direction of arrow A into a raised non-operative position when not in use, and can quickly be lowered in the direction of arrow A' to an operative, ground engaging position when needed.

The mounting yoke of the present invention also enables the contoured mounting block to be utilized with a variety of different types and styles of firearms, and enables the quick and easy attachment and detachment of the mounting block, and thus the bipod itself, to such firearms without requiring additional machinery and reconfigurations of the firearm as the present invention utilizes the swivel stud commonly found with most firearms for the quick and easy attachment of the bipod mounting block and thus the bipod thereto. Additionally, when the bipod and its mounting block have been removed from the firearm, the size and configuration of the mounting yoke does not interfere with the ability to grip the forearm stock portion of the firearm and thus does not interfere with the stability and aim of the shooter.

Figure 5:
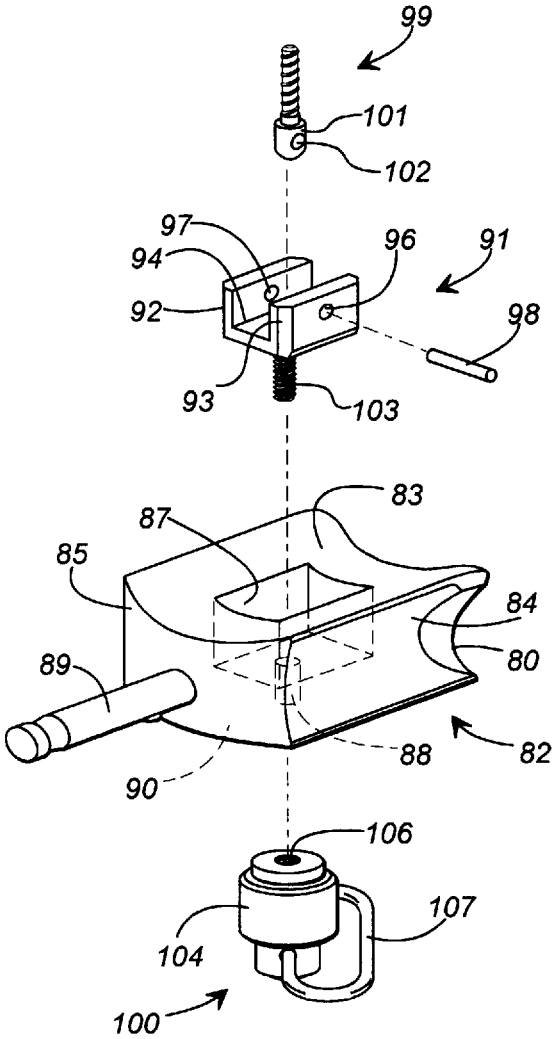
FIG. 5 is an exploded perspective view of a bipod mounting assembly that embodies principals of the invention in another preferred form.

FIG. 5 illustrates an exploded perspective view a mounting block assembly that embodies principles of this invention in an alternate form. The assembly 81 is similar to that shown in FIG. 2 and includes a generally rectangular mounting block 82 having a concave upper surface 83, side surfaces 84, a front surface 85, a rear surface 80, and a bottom surface 90. The upper surface 83 of the mounting block 82 is formed to define an upwardly open recess 87 that is generally square or cube-shaped and that has four sidewalls and a floor. A vertical bore 88 extends through the floor of the recess 87 and through the bottom surface 90 of the mounting block 82 for purposes described in more detail below. The front surface 85 of the mounting block 82 is provided with a mounting post 89 for engaging the locking means on a tripod such as that described above. The generally concave upper surface 83 of the mounting block 82 is shaped to conform to the contour of a rifle forearm stock so that, when the mounting block 82 is mounted to a rifle, the upper surface 83 of the mounting block rests securely and flatly against the bottom of the forearm stock of the firearm.

A yoke member 91 is adapted to be received in the upwardly open recess within the mounting block 82. More specifically, the yoke member 91 comprises an upwardly opened generally U-shaped yoke having parallel upstanding sides 92 and 93 that project from a bight portion or floor 94. Upstanding side 92 is provided with a pin receiving hole 97. Similarly, upstanding side 93 includes a pin receiving hole 96 that extends through the side 93 and that is aligned with the pin receiving hole 97 in the opposite side 92. The holes 96 and 97 are sized and configured to receive a metal pin 98. In use, the pin 98 is extended through the holes 96 and 97 and through a pin receiving hole 102 within the head 101 of a swivel mounting stud 99, which, in turn, is secured to the forearm stock of a rifle. Thus, the pin 98 secures the swivel mounting stud 99 within the yoke assembly 91.

A threaded stud 103 projects downwardly from the bight portion 94 of the yoke assembly and is sized and positioned to extend through the bore 88 when the yoke assembly is inserted within the upwardly open recess 87. Thus, when the swivel mounting stud 99 is secured within the yoke assembly of pin 98 and the yoke assembly is installed within the upwardly open recess 87, the pin 98 is prevented from sliding out of position by the walls of the recess 87 and the swivel mounting stud 99 is thus firmly secured within the yoke assembly.

A securing bolt assembly 100 has a body 104 formed with a knurled exterior surface. In the embodiment of FIG. 5, the body 104 is generally cylindrical in shape and has an upper surface provided with a threaded bore 106. The threaded bore 106 is sized and configured to receive the protruding threaded stud 103 of the yoke assembly 91 and to tighten onto the threaded stud when the securing bolt assembly 100 is rotated. This action causes the yoke assembly 91 and the attached swivel stud to be drawn tightly into the upwardly open recess 87 securing the mounting block 82 firmly to the bottom of a rifle's forearm stock. This configuration offers advantages in some situations over the configuration of FIG. 2, wherein the threaded stud 49 can sometimes engage the head 43 of the swivel mounting stud 99 when tightening the assembly, thus resulting in a less than completely tight fit.

It will be understood that while the foregoing relates to a preferred embodiment of the present invention, various modifications, additions and changes may be made thereto without departing from the spirit and scope of the invention as set forth in the following claims.

Further, it will be understood by those skilled in the art that while the present invention has been disclosed for use primarily with the Parker-Hale pipod assembly, the present invention also can be used for mounting the types of pipods having a biod leg frame that is releasibly mountable to a mounting block therefor to a firearm.

I claim:

1. For use with a firearm having a forearm stock provided with a swivel mounting stud, an adapter assembly for attachment to the swivel mounting stud to adapt the firearm to be releasably attached to a bipod support, said adapter assembly comprising:

a mounting block having bottom surface and an upper surface, said upper surface being contoured to conform to the shape of the forearm stock of a firearm to which said adapter assembly is to be attached;

means on said mounting block for releasably attaching said mounting block to a bipod support;

said mounting block being formed to define an upwardly open recess extending into said mounting block from said upper surface thereof to a floor of said recess;

said mounting block being further formed to define a through bore extending from said floor of said recess through said bottom surface of said mounting block;

a yoke member configured to be removably received in said recess;

fastening means on said yoke member for releasably fastening said yoke member to the swivel mounting stud of the forearm stock of the firearm;

a threaded stud projecting downwardly from said yoke member, said threaded stud being sized and positioned to extend through said through bore and to protrude from said bottom surface of said mounting block when said yoke member is disposed within said recess;

a securing bolt assembly having a body provided with a threaded bore, said threaded bore being configured to receive and be threaded onto said protruding threaded stud to draw said yoke member and the swivel mounting stud into said upwardly open recess and thereby draw said mounting block tightly against the forearm stock of the firearm.

2. An adapter assembly as claimed in claim 1 and wherein said mounting block is generally parallelepipedal and has opposed front and back surfaces and opposed side surfaces.

3. An adapter assembly as claimed in claim 2 and wherein said upwardly open recess is substantially cube shaped and is defined by four walls that extend upwardly from said floor of said recess.

4. An adapter assembly as claimed in claim 3 and wherein said yoke member is substantially U-shaped having a pair of spaced parallel walls extending upwardly from a bight section of said yoke member.

5. An adapter assembly as claimed in claim 4 and wherein said spaced parallel walls of said yoke member are provided with aligned pin receiving holes and wherein said fastening means on said yoke comprises a pin sized to be inserted through said aligned holes and through a like hole in a swivel mounting stud to fasten said yoke member to said swivel stud, said pin being held in place by said walls of said recess when said yoke member is disposed within said recess.

6. An adapter assembly as claimed in claim 5 and wherein said securing bolt assembly is substantially cylindrical and is provided with a detachable sling loop for receiving the shoulder sling of the firearm.

7. A bipod support for a firearm having a forearm stock provided with a swivel stud, said bipod support comprising:

a mounting block adapted to be mounted to the forearm stock portion of the firearm, said mounting block having a top face and a bottom face and being formed with a substantially cube shaped recess in said top face, said recess having a floor with a through bore extending from said floor of said recess through said bottom face of said mounting block;

a pair of legs connected to said mounting block and extending downwardly there from for supporting the firearm in a stable orientation; and means for releasably mounting said mounting block to the forearm stock portion of the firearm, said means comprising a substantially U-shaped yoke adapted to be received within said recess, said yoke having a base and a pair of spaced parallel side walls projecting upwardly from said base, means for securing the swivel stud of the forearm stock between said upwardly projecting walls, a stud projecting downwardly from said base of said yoke, said stud being sized and positioned to extend through said through bore and to protrude from said bottom face of said mounting block, and means attachable to said protruding stud for releasably securing said yoke in place within said recess.

8. A bipod support as claimed in claim 7 and wherein said stud is threaded and wherein said means attachable to said protruding stud comprises a securing bolt assembly having a threaded bore configured to be threadedly advanced onto said threaded protruding stud to draw said yoke into said recess and thus to tighten said mounting block to the forearm stock of the firearm.

9. For use with a firearm having a forearm stock provided with a swivel stud, a yoke assembly for securing a mounting block to the swivel stud, said yoke assembly comprising a generally U-shaped body receivable in a recess of the mounting block and having a flat base and a pair of spaced parallel walls projecting upwardly from said flat base, a first pin receiving hole formed in one of said walls and a second pin receiving hole formed in the other one of said walls, said first and second pin receiving holes being substantially aligned with each other, a pin sized to be inserted through said aligned pin receiving holes and through a hole in a swivel stud disposed between said spaced walls to secure the swivel stud to said yoke assembly, and a threaded stud secured to and projecting downwardly from said flat base for attaching said yoke assembly to the mounting block within the recess formed therein.

10. The yoke assembly of claim 9 and wherein said U-shaped body is formed of metal.

11. The yoke assembly of claim 9 and wherein said pin has opposed ends and wherein said pin is sized so that its ends are substantially flush with the outside faces of said walls when installed through said aligned pin receiving holes.

12. The yoke assembly of claim 9 and wherein said pin is loosely and removably received in said pin receiving holes and is held in place within said holes by the walls of said recess when said yoke assembly is disposed in said recess.

* * * * *